US006017092A

United States Patent [19]

Lee

[11] Patent Number: 6,017,092

[45] Date of Patent: Jan. 25, 2000

[54] STRUCTURE FOR CONNECTING A BACKREST TO A SEAT FRAME OF A CHAIR

[76] Inventor: Chain-Hsiang Lee, No. 12, Wai An Rd. Hua Chiao Chen, Kun Shan City, Chiang Su Province, China

[21] Appl. No.: 09/074,352

[22] Filed: May 7, 1998

[51] Int. Cl.[7] ..... A47C 7/00

[52] U.S. Cl. ..... 297/440.15; 297/440.18; 297/446.2; 297/446.1; 248/188

[58] Field of Search ..... 297/440.15, 446.2, 297/440.18, 440.23, 446.1, 440.1; 248/188.91, 220.1, 188

[56] References Cited

U.S. PATENT DOCUMENTS

| | | | |
|---|---|---|---|
| 1,181,156 | 5/1916 | Neal | 248/188.91 X |
| 1,526,009 | 2/1925 | Partington | 248/188 |
| 2,302,439 | 11/1942 | Greitzer | 248/188 |
| 2,485,784 | 10/1949 | Shoenberg | 248/188 |
| 2,651,355 | 9/1953 | Lucas | 297/446.1 |
| 2,709,485 | 5/1955 | Haven | 297/446.1 |
| 4,032,242 | 6/1977 | Morris | 248/188 X |

FOREIGN PATENT DOCUMENTS

| | | | |
|---|---|---|---|
| 497563 | 12/1950 | Belgium | 248/188 |
| 1075005 | 4/1954 | France | 248/188 |
| 120342 | 5/1901 | Germany | 248/188 |
| 34352 | 6/1905 | Switzerland | 297/446.1 |

*Primary Examiner*—Peter M. Cuomo
*Assistant Examiner*—David E. Allred
*Attorney, Agent, or Firm*—Patterson & Keough, P.A.

[57] ABSTRACT

A structure is provided for connecting a backrest to a seat frame of a chair, the backrest having two rear legs extending therefrom and the seat frame having a rear side, a front side and two sides connected between the rear side and the front side from which two front legs extend. The blocks each have two inclined side faces, a front surface and a rear surface so that the two blocks are respectively connected between the rear side and the two sides by extending two bolts through the front surface and the inclined side faces to threadedly engage with the two sides. Each of the blocks further has two apertures defined therethrough from the front surface to the rear surface thereof so that two bolts respectively extend through the apertures of each of the two blocks and are threadedly engaged to the backrest.

2 Claims, 3 Drawing Sheets

STRUCTURE FOR CONNECTING A BACKREST TO A SEAT FRAME OF A CHAIR

FIELD OF THE INVENTION

The present invention relates to a structure for connecting a backrest to a seat frame of a chair, comprising two block members respectively connected between a rear side and two sides of the seat frame, and two bolts respectively extending through the block members, the rear side and threadedly engaged with the backrest of the chair.

BACKGROUND OF THE INVENTION

A conventional chair generally includes a backrest connected to a seat frame on which a seat member is disposed, the backrest including two rear legs of the chair and two front legs respectively connected to two corners of an underside of the seat frame. The rear side has two tenons extending therefrom and the backrest has two mortises defined therein so as to receive the tenons. However, it requires skilled person to form the tenons and the mortises and this obviously increases manufacturing cost of the chair. Furthermore, the tenons extend in a direction perpendicular to the rear side of the seat frame and the direction is the same as connection of the backrest to the seat frame. In other words, when a person sits on the chair, he/she exerts a backward force to the backrest and tends to separate the backrest from the seat frame along the direction mentioned above. Even if nails are used to fixedly connect the backrest and the seat frame, the nails are conventionally nailed along the direction as described hereinbefore so that the force exerted to the backrest by the person sitting on the chair also tends to separate the backrest from the seat frame.

The present invention is to provide a structure for connecting a backrest to a seat frame and the structure includes at least one bolt inclinedly extending through the seat frame and fixedly connected to the backrest. By the structure of the present invention, the problems experienced with the conventional chair are mitigated and/or obviated.

SUMMARY OF THE INVENTION

In accordance with one aspect of the present invention, there is provided a structure for connecting a backrest to a seat frame of a chair, wherein said backrest has two rear legs extending therefrom and said seat frame includes a rear side, a front side and two sides connected between said rear side and said front side from which two front legs extend. The structure comprises two blocks each having two inclined side faces, a front surface and a rear surface, each of said blocks having at least two slots respectively defined inclinedly through said front surface to said two inclined side faces so that said two blocks are respectively connected between said rear side and said two sides by extending two bolts through said two slots to threadedly engage with said two sides. Each of said blocks has at least one aperture defined therethrough from said front surface to said rear surface thereof so that two bolts respectively extend through said respective apertures of said two blocks and are threadedly engaged to said backrest.

It is an object of the present invention to provide a connecting structure to connect the seat frame and the backrest, including two blocks connected between the rear side and two sides of the seat frame and each of the blocks having a bolt extending inclinedly therethrough and engaged with the backrest.

Further features of the present invention will become apparent after a careful reading of the detailed description with appropriate reference to the accompanying drawings.

DETAILED DESCRIPTION OF THE PREFERRED EMBODIMENT

Figure 1:
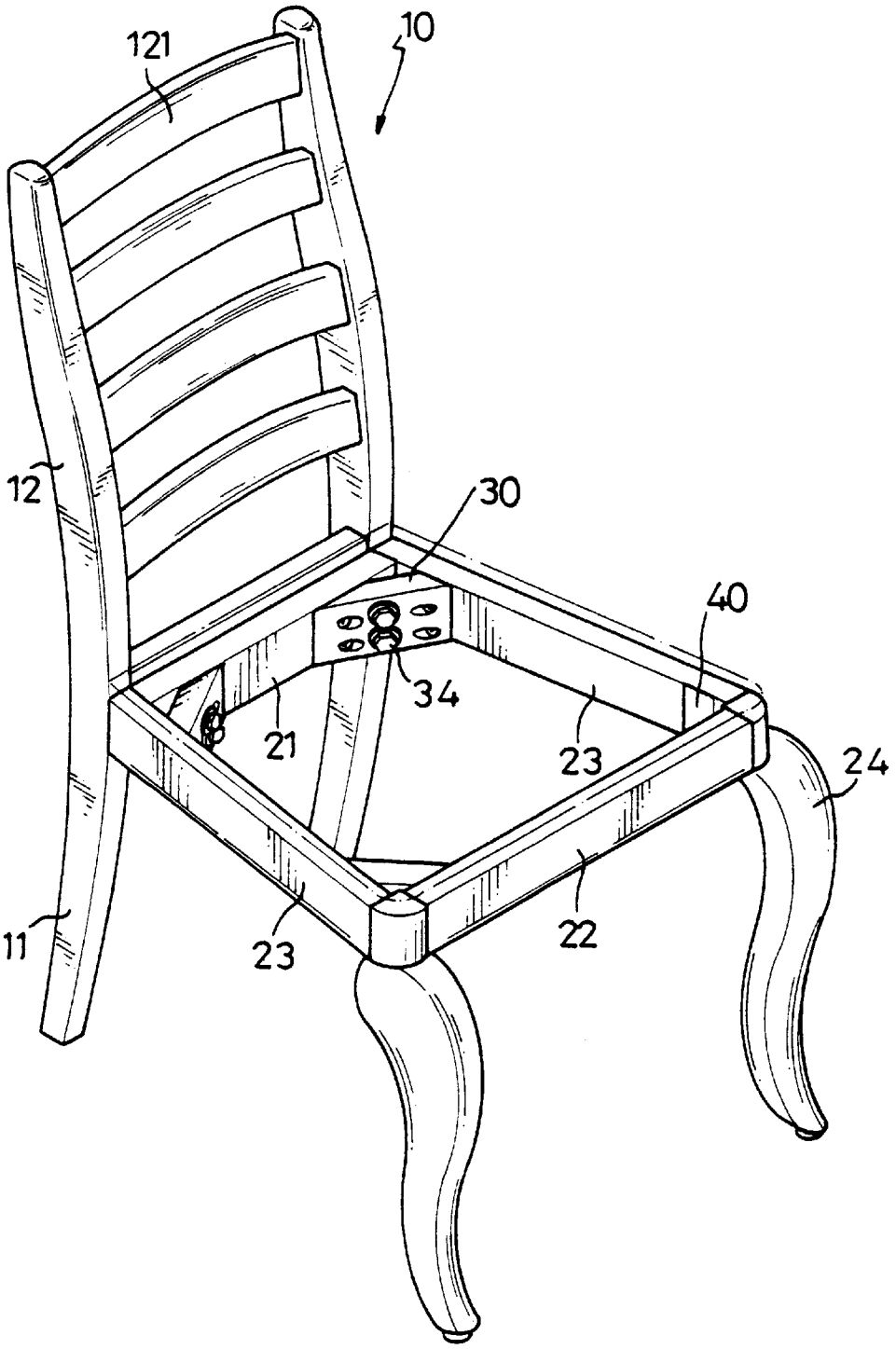
FIG. 1 is a perspective view to show a chair having a structure for connecting a backrest and a seat frame in accordance with the present invention.
Figure 2:
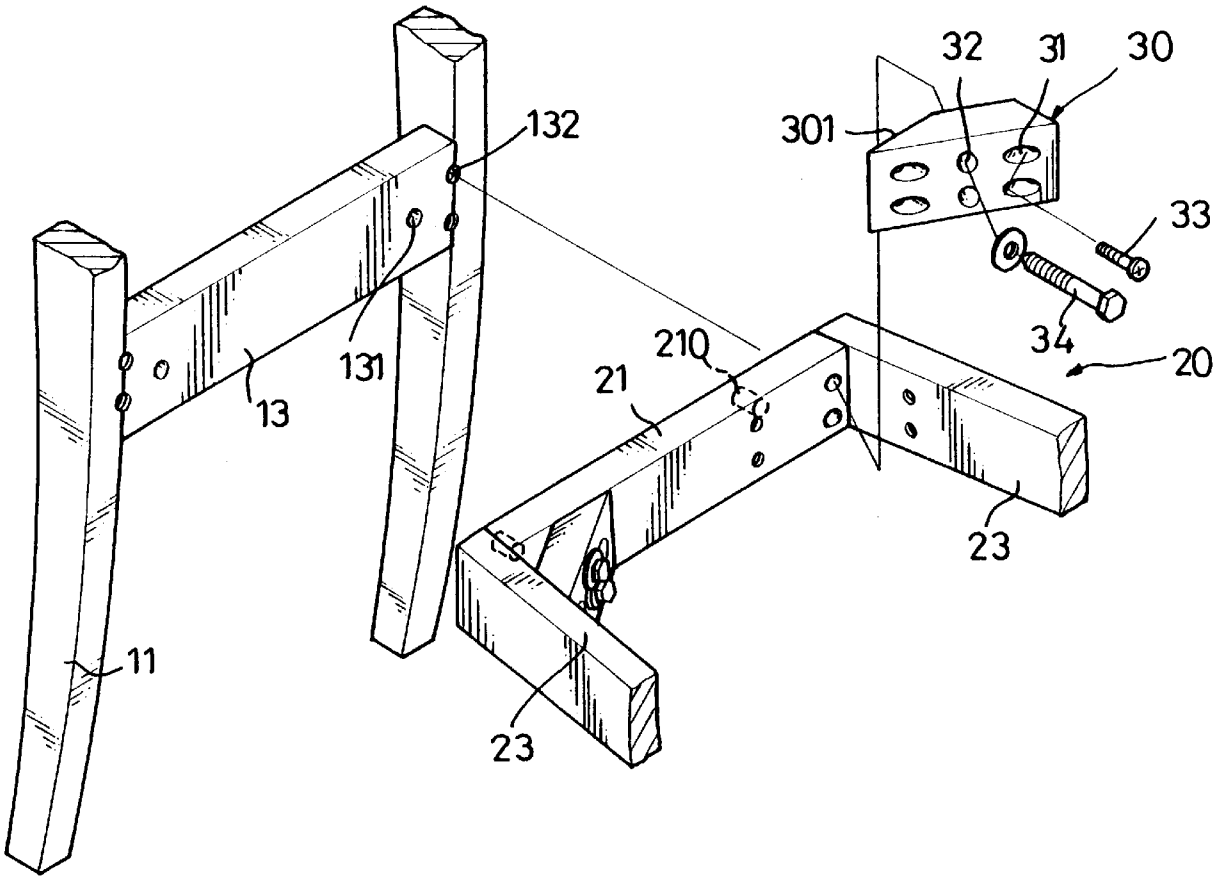
FIG. 2 is an exploded view to show the structure as shown in FIG. 1 of the present invention.
Figure 3:
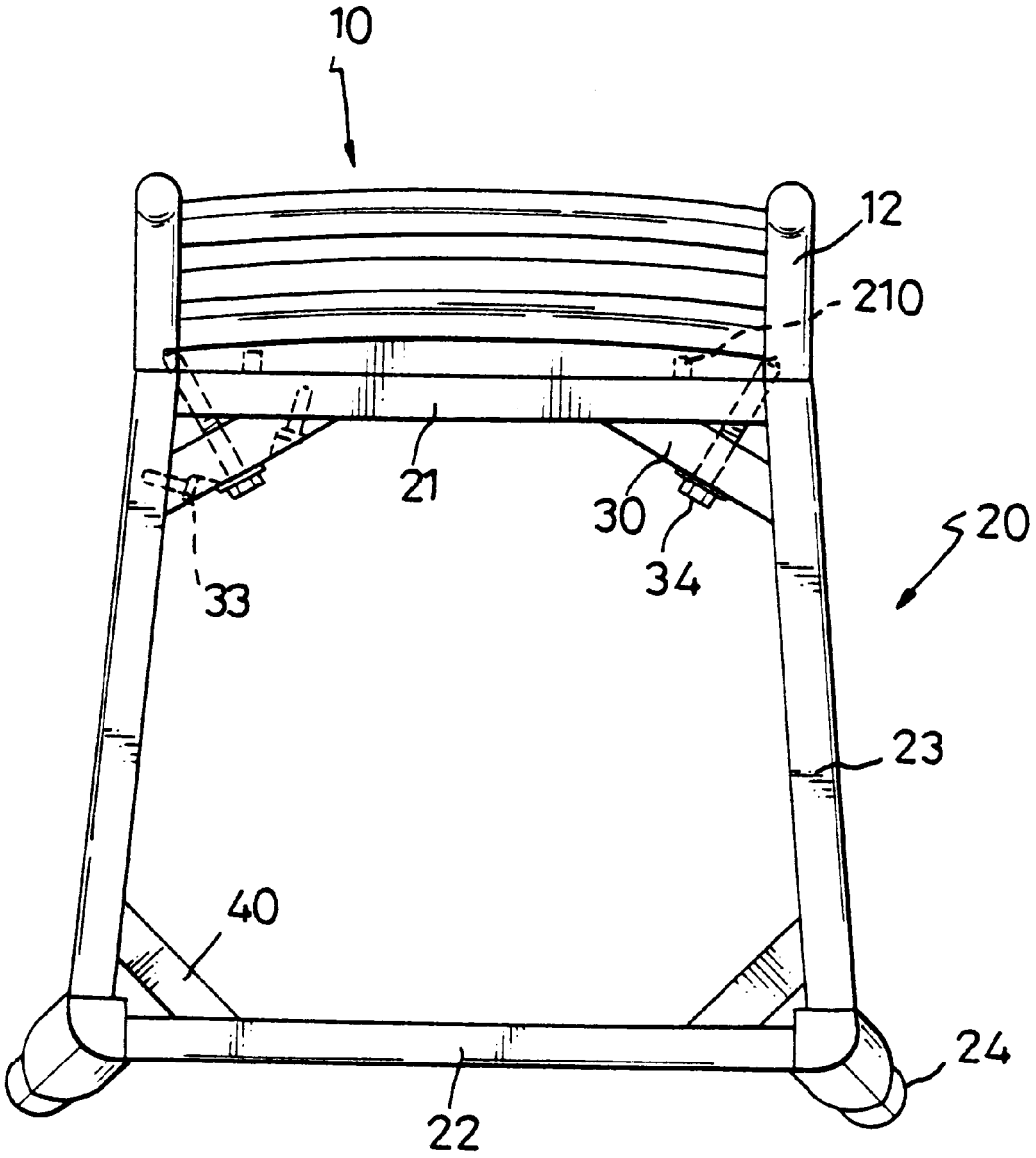
FIG. 3 is a top view to show two bolts inclinedly extending through two blocks, the seat frame and threadedly connected to the backrest.

Referring to FIGS. 1 through 3, a chair generally includes a backrest 10, a seat frame 20 on which a seat member (shown in phantom lines) is disposed, and two front legs 24 extending from the seat frame 20. The seat frame 20 is a rectangular frame and includes a rear side 21, a front side 22 and two sides 23 connected between said rear side 21 and said front side 22 from which the two front legs 24 extend. The rear side 21 has two protrusions 210 extending from an outer side thereof toward the backrest 10. The backrest 10 generally includes two side rails 12 with a plurality of transverse bars 121 connected between the two side rails 12 and the two rear legs 11 which integrally extend from the respective two side rails 12. A plate 13 is connected between the two side rails 12 and located corresponding to the rear side 21 of the seat frame 20. The plate 13 has two recesses 131 defined in a surface thereof and located corresponding to the protrusions 210 such that when assembling the backrest 10 and the seat frame 20, the two protrusions 210 are received in the respective recesses 131 so as to facilitate the assembling process. Two holes 132 are defined in an abutment between the plate 13 and each of the side rails 12.

The structure in accordance with the present invention comprises at least two blocks 30 each having two inclined side faces 301, a front surface and a rear surface. Each of said blocks 30 has four slots 31 respectively defined inclinedly through said front surface to said two inclined side faces 301 so that said two blocks 30 are respectively connected between said rear side 21 and said two sides 23 by extending four bolts 33 through said four slots 31 to threadedly engage with said two sides 23. In order to enforce the structure of the seat frame 20 two further blocks 40 are also connected between the front side 22 and the two sides 23 of the seat frame 20. Each of said blocks 30 has two apertures 32 defined therethrough from said front surface to said rear surface thereof and located between the two pairs of slots 31 so that two bolts 34 respectively extend through said apertures 32 of each of said two blocks 30, the rear side of the seat frame 20 to threadedly engage with the two holes 132 of said backrest 10. It is to be noted that each of said apertures 32 extends inclinedly corresponding to a longitudinal axis of said rear side 21 of said seat frame 20 so that when a person sits in the chair, his/her back exerts a force toward the backrest 10 in a direction which is not the same as the direction in which either one of the bolts 34 extends.

The structure of the present invention provides a simple way to enforce the structure between the backrest 10 and the seat frame 20. The present invention can be utilized directly to the presently available chair without requiring much modification to the chair.

It should be clear to those skilled in the art that further embodiments may be made without departing from the scope and spirit of the present invention.

What is claimed is:

1. A chair comprising a backrest having a plate with a longitudinal axis and with two rear legs protruding downward therefrom and two side rails protruding upward from said plate, a seat frame connected to said backrest and including a rear side, a front side and two sides connecting said rear side and said front side, two front legs protruding downward from said seat frame, an abutment formed between said plate and said two side rails of said backrest;

two blocks each having two inclined side faces, a front surface and a rear surface, each of said blocks having at least two slots respectively defined inclinedly through said front surface to said two inclined side faces so that each of said two blocks respectively connects said rear side of said seat frame and each of said two sides of aid seat frame by extending two bolts through said two slots from said front surface through respective side faces and threadedly engaged with said two sides of said seat frame, each of said blocks having at least one aperture defined therethrough from said front surface to said rear surface thereof, said at least one aperture extending inclinedly relative to the longitudinal axis of said plate of said backrest so that two bolts respectively extend through said at least one aperture of said two blocks, through said rear side, and are threadedly engaged to said backrest, and two holes defined in the abutment between said plate and said two side rails of said backrest so as to receive said bolts extending through said at least one aperture of a respective one of said two blocks.

2. The chair as claimed in claim 1 wherein said at least one aperture is located between said two slots of a respective one of said blocks.

* * * * *